US007414527B2

(12) United States Patent
McNay

(10) Patent No.: US 7,414,527 B2
(45) Date of Patent: Aug. 19, 2008

(54) SECURITY, TRACKING, AND DAMAGE CONTROL SYSTEM FOR CARGO CONTAINERS

(76) Inventor: James H. McNay, 4859 Jonquil Dr., Nashville, TN (US) 37211

( * ) Notice: Subject to any disclaimer, the term of this patent is extended or adjusted under 35 U.S.C. 154(b) by 168 days.

(21) Appl. No.: 11/481,834

(22) Filed: Jul. 7, 2006

(65) Prior Publication Data

US 2007/0030169 A1 Feb. 8, 2007

Related U.S. Application Data

(60) Provisional application No. 60/696,766, filed on Jul. 7, 2005.

(51) Int. Cl.
*G08B 1/08* (2006.01)

(52) U.S. Cl. ..... 340/539.13; 340/539.1; 340/585; 340/438; 340/439

(58) Field of Classification Search ..... 340/539.1, 340/539.13, 585, 438, 439; 346/33 TP; 374/186; 701/29, 30

See application file for complete search history.

(56) References Cited

U.S. PATENT DOCUMENTS 4,970,496 A * 11/1990 Kirkpatrick ..... 340/585
5,424,720 A * 6/1995 Kirkpatrick ..... 340/585
5,695,215 A * 12/1997 Headley et al. ..... 280/737
6,037,550 A * 3/2000 Bradley ..... 177/136
6,037,863 A * 3/2000 Collins ..... 340/443
6,449,582 B1 * 9/2002 Chaklader ..... 702/173
6,459,367 B1 * 10/2002 Green et al. ..... 340/440
6,532,716 B1 * 3/2003 Weis ..... 53/258

* cited by examiner

*Primary Examiner*—Daryl C. Pope

(57) ABSTRACT

A security, tracking and damage control system for use primarily within the commercial transportation industry. The system consists of a line containing a weight sensor within a security pad, and deploys LAN wireless communication between facility traffic control and tractors (trucks), yard tugs and receptor/detector transceivers located in line. A communications terminal, located in the truck, is preprogrammed at trucking company to include driver name, ID, truck number, and trucking company. Shipper will program trailer number and commodity, and any other relevant information pertaining to the shipment. This information will be relayed by shipper to consignee and will be verified automatically along with driver ID and truck number, when truck arrives at facility.

18 Claims, 6 Drawing Sheets

SECURITY, TRACKING, AND DAMAGE CONTROL SYSTEM FOR CARGO CONTAINERS

RELATED APPLICATIONS

The present application is a continuation-in-part application of U.S. provisional patent application, Ser. No. 60/696,766, filed Jul. 7, 2005, for LANDIT SECURITY, TRACKING, DAMAGE CONTROL AND SAFETY SYSTEM, by James H. McNay, included by reference herein and for which benefit of the priority date is hereby claimed.

FIELD OF THE INVENTION

The present invention relates generally to the security and tracking of cargo containers and more particularly, to areas of operations at distribution, warehouse and manufacturing facilities.

BACKGROUND OF THE INVENTION

Cargo theft in the United States has reached gigantic proportions. The FBI conservatively estimates annual losses at between $3.5 billion and $10 billion annually, while the Volpe Report from the Department of Transportation estimates indirect costs of those losses at between $20 billion and $60 billion annually. A disturbing number of those thefts (40% by some estimates) involve driver and warehouse personnel complicity.

Trailer theft by deception is not uncommon. Fraudulent authorization papers presented to security by a driver will allow that driver to depart the facility with a stolen trailer.

Many facilities are closed when trucks arrive, and drivers are dependent on prior dispatch information to accurately drop and hook trailers. Information received by a driver from dispatch prior to arrival at facility is rendered inaccurate if changes have been made at the designated facility and the driver is unaware of these changes.

At large busy facilities traffic control generally does not always have an accurate account of the disposition of trailers, dock doors or parking space that is already occupied. It is common practice at facilities for security to instruct an incoming truck to park the trailer in a designated parking area without assigning a parking space number to driver. Security and traffic control are dependent on driver to inform them of parking space location of parked trailers and the parking space location from which a trailer is retrieved for departure from the facility.

It is not uncommon at large facilities for traffic control to dispatch a yard tug driver to go and "find" a particular trailer and report its location back to traffic control.

Crowded, disorganized parking of trailers at parking areas within the facility is commonplace. Equipment and property are damaged by drivers in the process of parking and retrieving trailers at these areas.

Security at some facilities is non existent. At other facilities, security consists of a security guard making rounds of the property at regular intervals. However, a security guard can not be in all places at all times.

Other measures of security presently employed include cameras and seals or locks on trailer doors, but cameras are easily rendered inoperable, and seals and locks can be cut with bolt cutters or a hacksaw.

Satellite communication is employed in specific areas of truck operations and is primarily a tracking system that 'observes' from space. However, satellite tracking, while useful in some areas of the industry, is susceptible to atmospheric and technical interference. It also does not address the continuous multiple tracking, loading/unloading, parking, damage control and security problems presently existing at large busy facilities. In addition, the effectiveness of the satellite tracking system is dependent on an attachment to the trailer to accommodate satellite tracking signal, and any attachment to a trailer is vulnerable to vandalism, theft or deactivation.

While some large facilities do have computerized tracking systems in place, They are simply that—tracking systems for containers within that particular facility. None are integrated into a security line which alerts security and other authorities when a breach of security takes place.

It is an object of the invention to provide a security, tracking and damage control system relevant to cargo containers within the transportation industry.

It is another object of this invention to have a security system in place that instantaneously detects and defines unauthorized activity such as intrusion into a trailer or container, removal of commodity from trailer or container, or movement of trailer or container.

It is another object of this invention to alert facility security and other authorities instantaneously when tampering of a container occurs.

It is another object of this invention to prevent damage to property and vehicles by providing drivers with a visible and audio guidance system when backing up to dock doors or parking spaces.

It is another object of the invention to log and record automatically all vehicles entering and departing a distribution facility, with a security check system in place that detects errors related to driver name and I.D., bills of lading, tampering or incompatible I.D. code numbers, to investigate mistakes, and prevent unauthorized entry into or movement of trailers or containers.

It is another object of the invention to create an automatic vehicle tracking system that instantly records and updates on Traffic Control computers all vehicle movements within distribution facilities at the exact instant the activity takes place.

It is another object of the invention to implement a yard tug system that automatically assigns yard tugs to extract or insert trailers at dock doors and parking spaces. This tug locator system will assign the closest tug to the location of the trailer to be extracted from a dock door, thus saving time and fuel.

It is another object of the invention to implement automatic, reliable communications between Traffic Control and mobile/yard tugs, and record instantaneously and automatically the insertion and extraction of trailers at dock doors and parking spaces, including stationary times of parked trailers at Traffic Control monitoring computers.

SUMMARY OF THE INVENTION

In accordance with the present inventions there is provided a security, tracking and damage control system for use primarily within the commercial transportation industry. The system consists of a line containing a weight sensor and a confirmation security pad, and deploys LAN wireless and broadband communication between facility traffic control and tractors (trucks), yard tugs and receptor/detector transceivers located in line. A communications terminal, located in the truck, is preprogrammed at trucking company to log driver name, truck number, and trucking company. Trailer number, commodity and any other relevant information pertaining to the shipment will be programmed by the shipper and this information will be relayed by shipper to consignee and will be verified automatically, along with driver ID and truck number, when truck arrives at facility.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

The present invention is a method and apparatus for automatically verifying, tracking and security of cargo containers for use in the transportation industry. The invention is described in the context of a commercial tractor-trailer vehicle having a mobile communications terminal 13 in contact with a central station in a facility. Although this invention is used in conjunction with wireless based communication systems, it should be understood that it may be used in satellite-based communications systems as well. Furthermore, the present invention may be used in a variety of vehicles, such as commercial trucks, busses, passenger vehicles, or airplanes.

Figure 1:
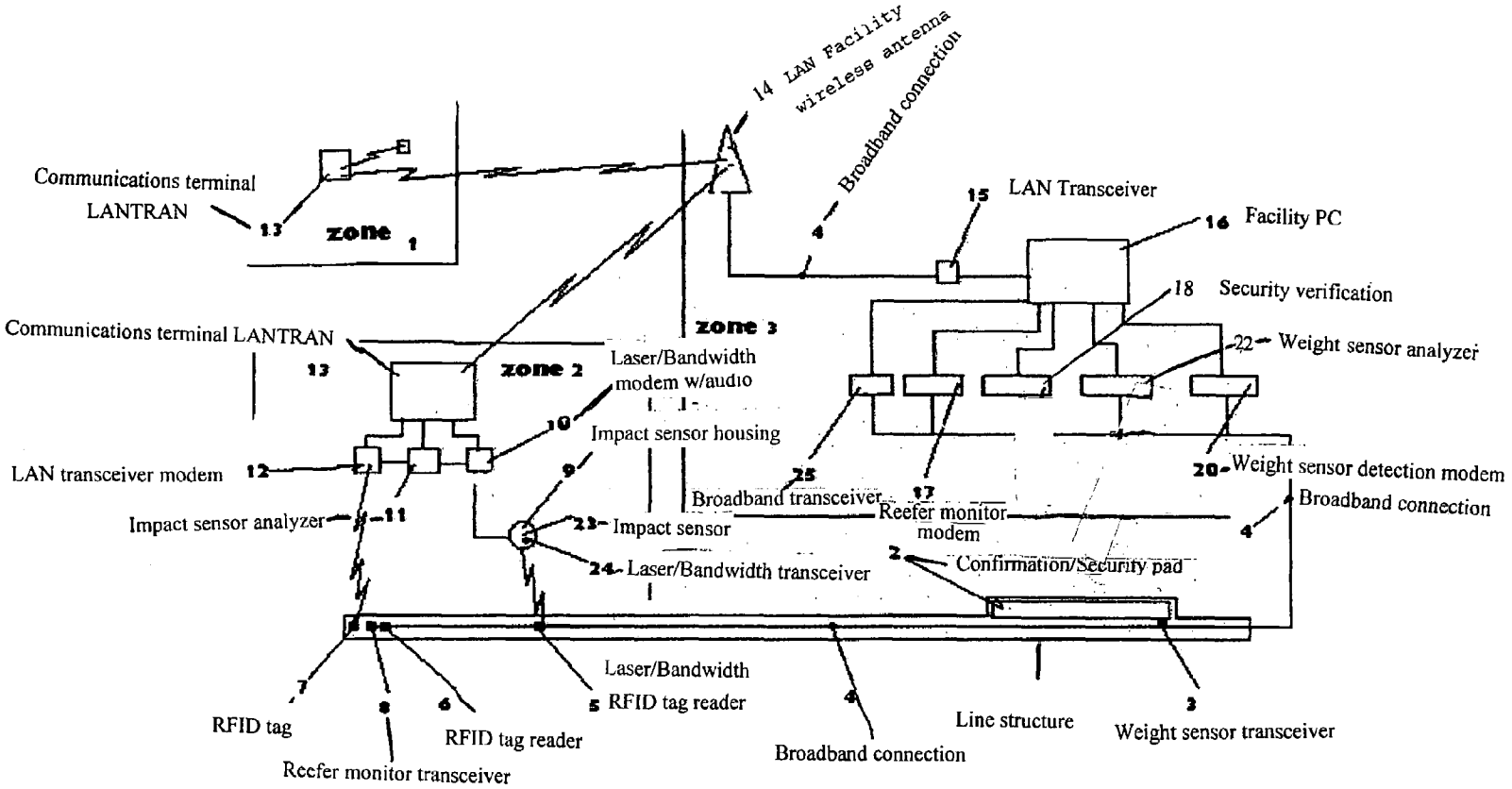
FIG. 1 is a perspective view of an all of the elements contained in the present invention.

Reference is made to FIG. 1, which illustrates the apparatus necessary for the new method of security, tracking and damage control for cargo containers. As illustrated in FIG. 1 the line structure 1 contains a weight confirmation security pad 2, a weight sensor transceiver 3, broadband line connection 4, laser bandwidth reader tag 5, RFID tag reader 6, parking space/dock door reader 7 and reefer monitor transceiver 8.

Upon arrival at the facility entrance gate, the gate transceiver 21 reads and verifies the preprogrammed information contained in the communications terminal 13 identifying the driver ID, the truck ID, and container ID and other information relative to this particular shipment. This preprogrammed information is transmitted automatically via LAN wireless system 15 to the facility control via the communications terminal 13 transceiver at the communications terminal 13. Upon verification of this information, facility traffic control computer 16 instructs driver, via communications terminal 13, to proceed to a particular dock door or parking space within the facility.

As driver proceeds to back container into assigned parking space, the communications terminal 13 transceiver reads the parking space/dock door RFID tag reader 6 in the line structure 1. The parking space and/or dock door number and other pertinent information is wireless transmitted via communications terminal 13 in truck to facility traffic control computer 16, and the laser bandwidth transceiver 24 is activated. Upon activation of the laser bandwidth transceiver 24, driver is guided visibly by viewing laser beam transmission contacting line structure 1. When laser bandwidth transmission makes contact and reads the strategically placed laser bandwidth reader tag 5 in line structure 1, visible signal is apparent to driver and bandwidth transmission activates audio modem transceiver at communications terminal 13, alerting driver to stop. This places landing gear of 53' container adjacent to the location of the bandwidth laser tag in line structure 1, and positions rear of container approximately 6 to 8 inches from the dock door, preventing hard, damaging impact of container against dock door.

It should be noted that the laser bandwidth RFID reader tag that accommodates the laser bandwidth transmission can be positioned within the line structure 1 to accommodate containers of various lengths. It should also be noted that the laser beam bandwidth transmission can be manually activated by driver and utilized independent of the line structure 1 in parking areas where landing gear must come to rest atop trailer landing gear accommodation pad, preventing vehicle and property damage.

At insertion of trailer into assigned parking space, and when wheels position atop the confirmation security pad 2 segment of the line structure 1, it activates the weight sensor transceiver 3, which in turn is read at the weight sensor analyzer 22 located at facility traffic control computer 16, and activates security verification system 18 at facility traffic control computer 16. Any unauthorized entry into, removal of commodity in container, or movement of container will cause a variation in weight, and will be detected at weight sensor transceiver 3, which will communicate weight variation via either LAN wireless or broadband to facility control computer and will initiate alarm system at facility traffic control computer 16.

Figure 2:
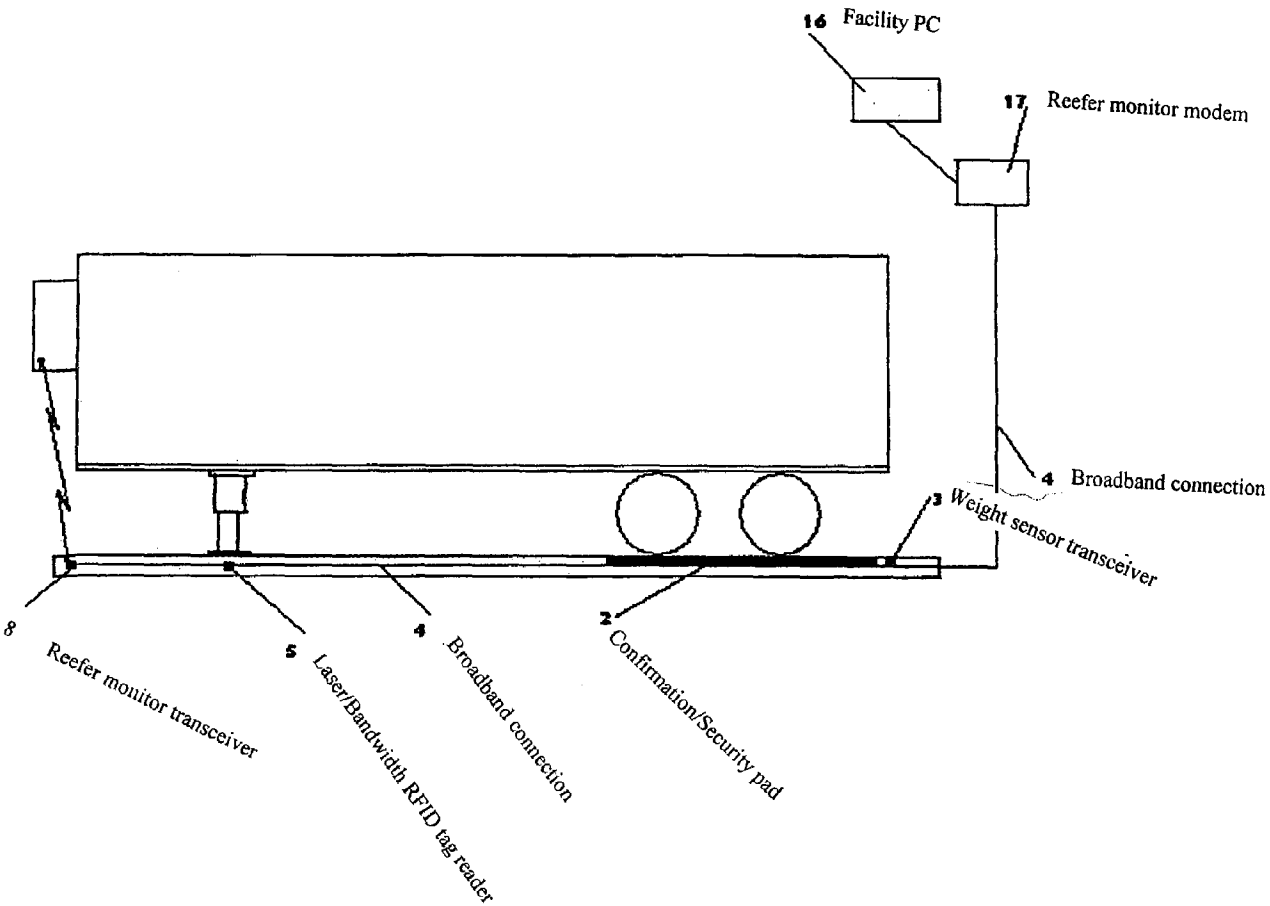
FIG. 2 is a perspective view of a reefer monitoring segment of the invention.

FIG. 2 illustrates a container parked on the line structure 1 and having the reefer functions monitored by the reefer monitoring system located at the end of the line. Any variation in the functions will be detected at reefer monitoring modem 17 at traffic control computer.

Figure 3:
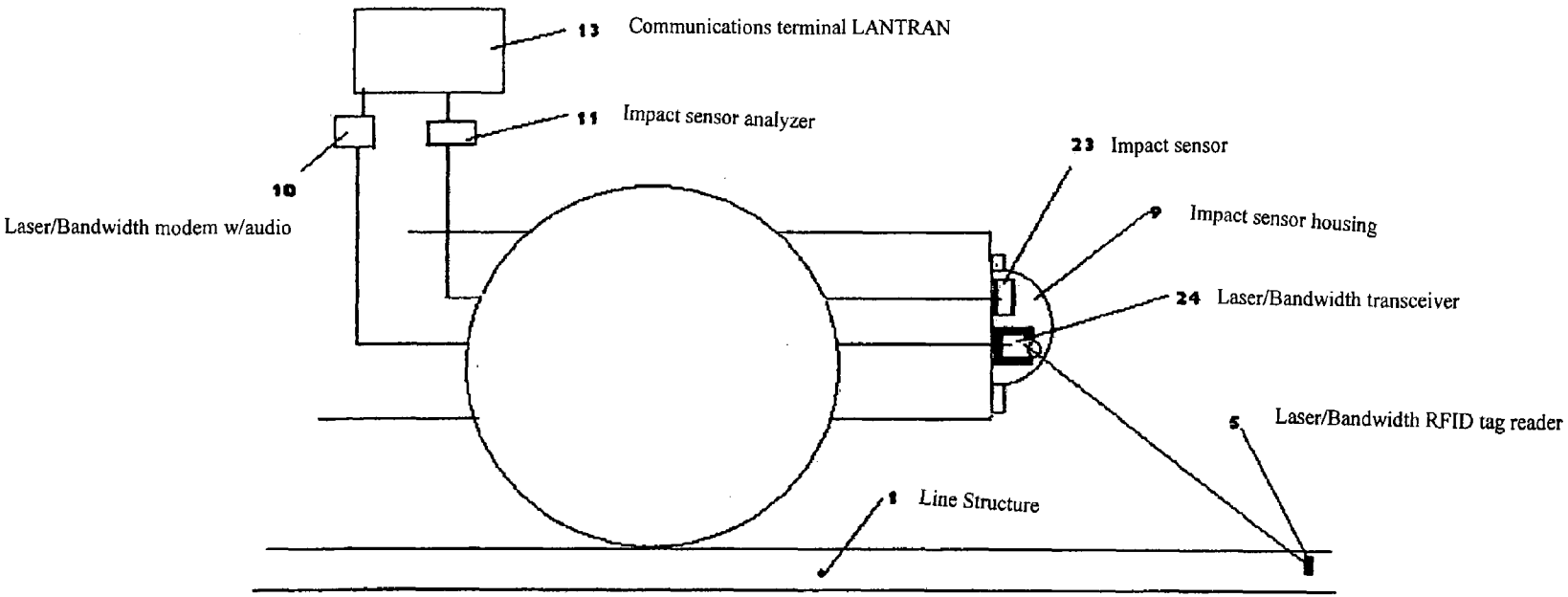
FIG. 3 is a perspective view of an impact sensor and laser bandwidth transceiver.

FIG. 3 is side view of rear of tractor parked on the line structure 1, displaying location of the laser bandwidth transceiver 24 and impact sensor 23 in protective housing 9. The laser bandwidth transceiver 24 is automatically activated when the communications terminal 13 reads the RFID tag at line, and at process of backing container into parking space, will communicate with the laser bandwidth reader tag 5 in line. This will activate visible signal and audio tone in truck cab, alerting driver to stop, placing rear of container approximately 6 to 8 inches from dock door stops to prevent damaging impact between vehicle and property. Any hard, damaging impact between container rear and dock door will be detected by impact sensor 23 and communicated, via broadband or wireless, to communications terminal 13 and to facility traffic control computer 16, identifying driver and truck.

Figure 4:
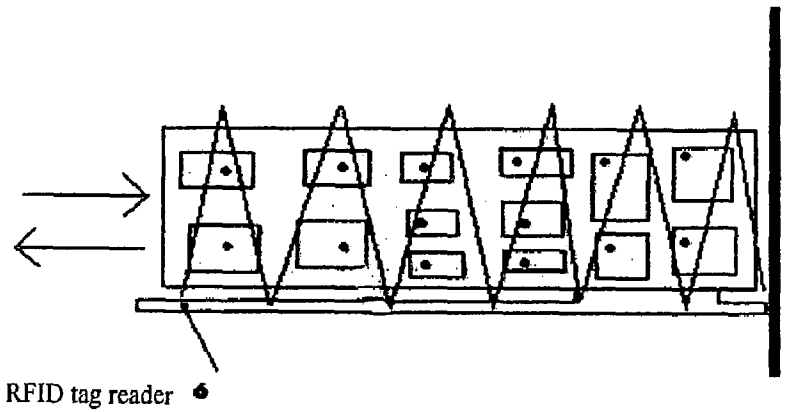
FIG. 4 is a perspective view of a rfid tag reader reading tags on commodity in container.

FIG. 4 shows the activity of the RFID tag reader 6 in line, which reads RFID tags on packaging within container when container is extracted from docking door at shipper. This scanning information is recorded and logged at facility traffic control. At consignee, when trailer is inserted into dock door, the RFID tags are again read by the RFID tag reader 6 and communicated and logged at facility traffic control so that departure and arrival of contents of container can be verified.

Figure 5:
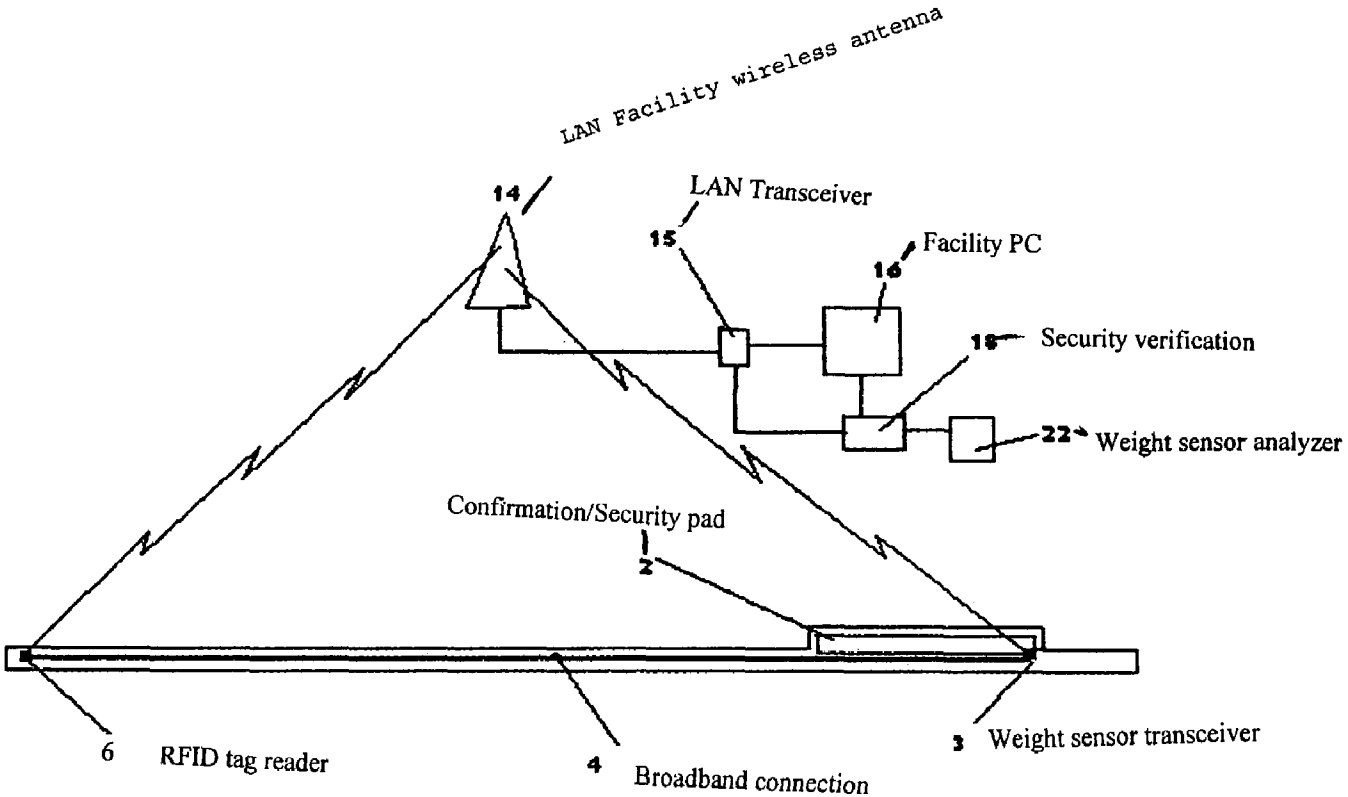
FIG. 5 is a perspective view of a lan communication between facility control and weight sensor transceiver and rfid tag.

FIG. 5 is an illustration of line structure 1 at parking area, illustrating broadband communications between weight sensor transceiver 3 and RFID tag in line structure 1 to facilitate wireless communication between line and facility traffic control computer 16. Weight sensor transceiver 3 and RFID tag reader 6 are connected by broadband and have the capability of communicating jointly or independently with facility traffic control computer 16 via LAN wireless facility antenna 14. This application is utilized by facility traffic control to verify disposition of parking space. All communications between the line structure 1 accommodating containers and facility traffic control computer 16 are accommodated within the LAN perimeter at facility. Any interruption or malfunction, whether natural or intentional, of broadband or LAN wireless communication signal will be instantly detected by the facility traffic control computer 16.

Figure 6:
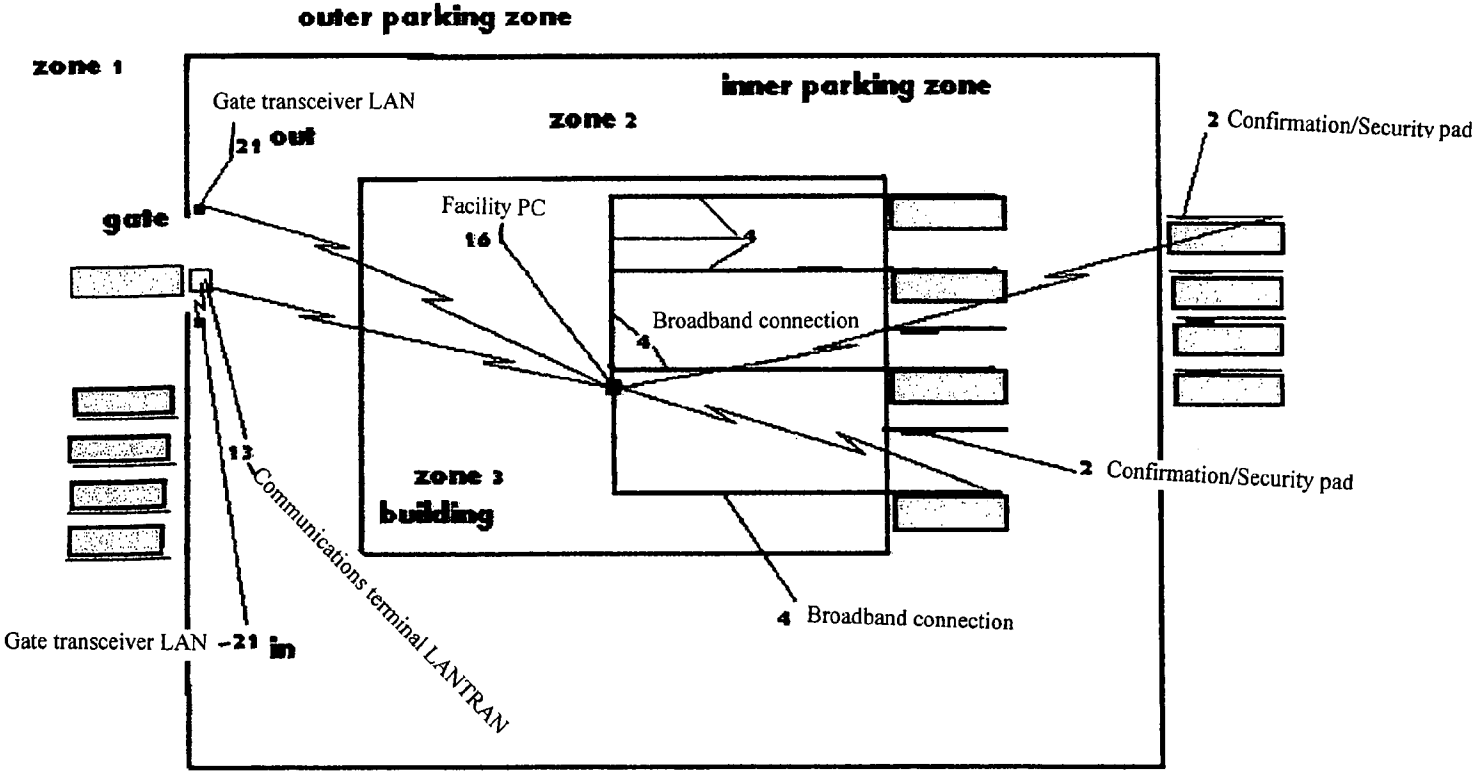
FIG. 6 is a perspective view of a communications zone areas within the lan perimeter of facility.

FIG. 6 illustrates three zones in a facility. Zone 1 covers the outer parking area of the facility's LAN wireless perimeter. Zone 2 is area that accommodates dock door parking areas and adjacent parking space. Zone 3 is the facility's building. This figure displays the LAN wireless perimeter.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A security, tracking, and damage control system for cargo containers for providing a security and tracking system for the transportation industry, comprising:

means for providing visible driver guidance at backing into dock doors, the line structure, which is flat on underside and slightly curved on upper surface is constructed of any appropriate durable material, and also provides protective housing for hermetically sealed technical components;

means for detecting application of vehicle wheel weight;

means for detecting laser bandwidth transmission from vehicle;

means for monitoring reefer operations on trailer or container;

means for protecting the impact sensor and the laser bandwidth transceiver;

means for detecting the laser bandwidth reader tag in line;

means for detecting hard impacts between vehicle and dock door;

means for interpreting and identifying parking space and dock door number at communications terminal;

means for reading and analyzing the reefer monitor transceiver;

means for activating and monitoring wheel weight application on confirmation security pad;

means for providing power source to analyze rfid tag data;

means for verifying the preprogrammed information relevant to the load;

means for detecting initial weight and communicating weight variations, via broadband or wireless communication, to the weight sensor analyzer at facility traffic control security system;

means for determining weight variation and relaying information to facility traffic control computer; and means for detecting hard, damaging impacts.

2. The security, tracking, and damage control system for cargo containers in accordance with claim 1, wherein said means for providing visible driver guidance at backing into dock doors, the line structure, which is flat on underside and slightly curved on upper surface, is constructed of any appropriate durable material, and also provides protective housing for hermetically sealed technical components comprises a line structure.

3. The security, tracking, and damage control system for cargo containers in accordance with claim 1, wherein said means for detecting application of vehicle wheel weight comprises a confirmation security pad.

4. The security, tracking, and damage control system for cargo containers in accordance with claim 1, wherein said means for detecting laser bandwidth transmission from vehicle comprises a laser bandwidth reader tag.

5. The security, tracking, and damage control system for cargo containers in accordance with claim 1, wherein said means for monitoring reefer operations on trailer or container comprises a reefer monitor transceiver.

6. The security, tracking, and damage control system for cargo containers in accordance with claim 1, wherein said means for protecting the impact sensor and the laser bandwidth transceiver comprises a housing.

7. The security, tracking, and damage control system for cargo containers in accordance with claim 1, wherein said means for detecting the laser bandwidth reader tag in line comprises a laser bandwidth audio signal modem.

8. The security, tracking, and damage control system for cargo containers in accordance with claim 1, wherein said means for detecting hard impacts between vehicle and dock door comprises an impact sensor analyzer.

9. The security, tracking, and damage control system for cargo containers in accordance with claim 1, wherein said means for interpreting and identifying parking space and dock door number at communications terminal comprises a line rfid tag reader.

10. The security, tracking, and damage control system for cargo containers in accordance with claim 1, wherein said means for reading and analyzing the reefer monitor transceiver comprises a reefer monitoring modem.

11. The security, tracking, and damage control system for cargo containers in accordance with claim 1, wherein said means for activating and monitoring wheel weight application on confirmation security pad comprises a security verification system.

12. The security, tracking, and damage control system for cargo containers in accordance with claim 1, wherein said means for providing power source to analyze rfid tag data comprises a rfid tag reader modem.

13. The security, tracking, and damage control system for cargo containers in accordance with claim 1, wherein said means for verifying the preprogrammed information relevant to the load comprises a gate transceiver.

14. The security, tracking, and damage control system for cargo containers in accordance with claim 1, wherein said means for detecting initial weight and communicating weight variations, via broadband or wireless communication, to the weight sensor analyzer at facility traffic control security system comprises a weight sensor transceiver.

15. The security, tracking, and damage control system for cargo containers in accordance with claim 1, wherein said means for determining weight variation and relaying information to facility traffic control computer comprises a weight sensor analyzer.

16. The security, tracking, and damage control system for cargo containers in accordance with claim 1, wherein said means for detecting hard, damaging impacts comprises an impact sensor.

17. A security, tracking, and damage control system for cargo containers for providing a security and tracking system for the transportation industry, comprising:

a line structure, for providing visible driver guidance at backing into dock doors, the line structure, which is flat on underside and slightly curved on upper surface, is constructed of any appropriate durable material, and also provides protective housing for hermetically sealed technical components;

a confirmation security pad, for detecting application of vehicle wheel weight;

a laser bandwidth reader tag, for detecting laser bandwidth transmission from vehicle;

a reefer monitor transceiver, for monitoring reefer operations on trailer or container;

a housing, for protecting the impact sensor and the laser bandwidth transceiver;

a laser bandwidth audio signal modem, for detecting the laser bandwidth reader tag in line;

an impact sensor analyzer, for detecting hard impacts between vehicle and dock door;

a line rfid tag reader, for interpreting and identifying parking space and dock door number at communications terminal;

a reefer monitoring modem, for reading and analyzing the reefer monitor transceiver;

a security verification system, for activating and monitoring wheel weight application on confirmation security pad;

a rfid tag reader modem, for providing power source to analyze rfid tag data;

a gate transceiver, for verifying the preprogrammed information relevant to the load;

a weight sensor transceiver, for detecting initial weight and communicating weight variations, via broadband or wireless communication, to the weight sensor analyzer at facility traffic control security system;

a weight sensor analyzer, for determining weight variation and relaying information to facility traffic control computer; and an impact sensor, for detecting hard, damaging impacts.

18. A security, tracking, and damage control system for cargo containers for providing a security and tracking system for the transportation industry, comprising:

a line structure, for providing visible driver guidance at backing into dock doors, the line structure, which is flat on underside and slightly curved on upper surface, is constructed of any appropriate durable material, and also provides protective housing for hermetically sealed technical components;

a confirmation security pad, for detecting application of vehicle wheel weight;

a laser bandwidth reader tag, for detecting laser bandwidth transmission from vehicle;

a reefer monitor transceiver, for monitoring reefer operations on trailer or container;

a housing, for protecting the impact sensor and the laser bandwidth transceiver;

a laser bandwidth audio signal modem, for detecting the laser bandwidth reader tag in line;

an impact sensor analyzer, for detecting hard impacts between vehicle and dock door;

a line rfid tag reader, for interpreting and identifying parking space and dock door number at communications terminal;

a reefer monitoring modem, for reading and analyzing the reefer monitor transceiver;

a security verification system, for activating and monitoring wheel weight application on confirmation security pad;

a rfid tag reader modem, for providing power source to analyze rfid tag data;

a gate transceiver, for verifying the preprogrammed information relevant to the load;

a weight sensor transceiver, for detecting initial weight and communicating weight variations, via broadband or wireless communication, to the weight sensor analyzer at facility traffic control security system;

a weight sensor analyzer, for determining weight variation and relaying information to facility traffic control computer; and an impact sensor, for detecting hard, damaging impacts.

* * * * *